US007198222B2

(12) United States Patent
Rydalch

(10) Patent No.: US 7,198,222 B2
(45) Date of Patent: Apr. 3, 2007

(54) DRILL-OPERATED TOOL TO ASSIST IN THE OPENING OF FIBER-OPTIC CABLES

(75) Inventor: Monte G. Rydalch, South Jordan, UT (US)

(73) Assignee: Qwest Communications International Inc., Denver, CO (US)

( * ) Notice: Subject to any disclaimer, the term of this patent is extended or adjusted under 35 U.S.C. 154(b) by 224 days.

(21) Appl. No.: 10/686,546

(22) Filed: Oct. 14, 2003

(65) Prior Publication Data

US 2005/0077410 A1 Apr. 14, 2005

(51) Int. Cl.
*B65H 75/22* (2006.01)

(52) U.S. Cl. ..... 242/608.4

(58) Field of Classification Search ..... 242/472.5, 242/608.5, 608.8, 118.62, 902, 250, 608.4, 242/611, 611.5; 29/828, 426.1, 426.5, 762, 29/764, 868

See application file for complete search history.

(56) References Cited

U.S. PATENT DOCUMENTS

| | | | | |
|---|---|---|---|---|
| 5,277,350 | A * | 1/1994 | Thornbury, Jr. | 244/155 A |
| 5,868,348 | A * | 2/1999 | Bulman | 242/608.5 |
| 6,648,262 | B1 * | 11/2003 | Huffman | 242/390.8 |
| 6,732,426 | B2 * | 5/2004 | Adams | 29/762 |
| 2001/0029814 | A1 * | 10/2001 | Tiano | 81/119 |

* cited by examiner

*Primary Examiner*—Patrick Mackey
*Assistant Examiner*—William E Dondero
(74) *Attorney, Agent, or Firm*—Townsend and Townsend and Crew

(57) ABSTRACT

A tool is provided for opening a cable having a length of filament disposed within a sheath. The tool has a mechanism for gripping an end of the filament and is equipped to be engaged with a powered mechanical rotation device that rotates a column about which the filament is spooled as the column is rotated. The spooled filament is confined to a longitudinal region by flanges, one of which may be removed to release the filament from the longitudinal region after it is spooled.

10 Claims, 5 Drawing Sheets

DRILL-OPERATED TOOL TO ASSIST IN THE OPENING OF FIBER-OPTIC CABLES

BACKGROUND OF THE INVENTION

This application relates to opening a cable having a length of filament disposed within a sheath.

One example of cable structure that includes a length of filament disposed within a sheath is a fiber-optic cable. As is well known, a typical fiber-optic cable includes an optical fiber that is disposed within a cable sheath, which may be composed of a polymeric material. The optical fiber includes a silicon oxide glass core (which may be doped to achieve specific optical characteristics) surrounded by a cladding layer to ensure total internal reflection of light, with the core and cladding layer surrounded by a fiber coating. The fiber optic-cable may additionally include a strength member or plurality of strengthening fibers made of a material such as a nylon aramid. Sometimes such strength members are referred to colloquially in the art as "piano wires."

Opening a cable having such a structure, such as may be desired for breakout of the internal filament during field installation operations, may require considerable physical exertion. There are many instances in which technicians have suffered injuries in attempting to open such cables manually, including significantly disabling back injuries and the like. One example of a tool that has sometimes been used to assist in the opening of such cable structures is illustrated in FIG. 1. The illustrated tool 100 is commonly referred to in the art as a "Jones tool" and is equipped with a gripping mechanism similar to that provided with vise grips. While use of such a tool by a technician does modestly facilitate opening cables, the operation remains an entirely manual operation that may still require considerable exertion, with the possibility of injury.

There is accordingly a general need in the art for improved tools and methods for opening cables having a length of filament disposed within a sheath.

BRIEF SUMMARY OF THE INVENTION

In a first set of embodiments of the invention, a tool is provided for opening a cable having a length of filament disposed within a sheath. The tool comprises a proximal portion, a distal portion, and a column that is coupled with one of the proximal and distal portions and detachably engaged with the other of the proximal and distal portions. The proximal portion has a first flange connected with a shaft extending from the flange and adapted for engagement with a powered mechanical rotation device. The distal portion has a second flange. The column includes a cavity adapted to grip the filament and is disposed such that the cavity is between the first and second flanges when the column is engaged with the other of the proximal and distal portions.

In some such embodiments, the column may be fixedly coupled with the one of the proximal and distal portions. In some instances, the column may comprise a hollow interior, with the cavity comprising a hole extending through a surface of the column to the hollow interior. A plurality of cavities may be provided, with each such cavity being adapted to grip the filament. In one embodiment, the first flange comprises a threaded hole and the column is threaded at a proximal end for threading into the threaded hole; in this embodiment, the column is thereby detachably engaged with the proximal portion and coupled with the distal portion. In another embodiment, the second flange comprises a threaded hole and the column is threaded at a distal end for threading into the threaded hole; in this embodiment, the column is thereby detachably engaged with the distal portion and coupled with the proximal portion. The filament may comprise a strength member of an optical-fiber cable and the powered mechanical rotation device may be a hand-held drill in certain embodiments.

In a second set of embodiments, a method is provided for opening a cable having a length of filament disposed within a sheath. An end of the filament is attached to a tool having a column disposed between two flanges. The column includes a cavity adapted to grip the filament. Thereafter, the column is rotated to pull the filament from the sheath and to spool the filament about the column. Thereafter, one of the flanges is separated from the column to release the spooled filament.

In some of these embodiments, the column is rotated with a powered mechanical rotation device such as a hand-held drill. The tool may further have a shaft extending from a first of the flanges, with the rotation of the column being performed with a powered mechanical rotating device engaged with the shaft. In such cases, either the first flange or the second flange may be separated from the column to release the spooled filament. Also, the flange that is separated from the column may comprise a threaded hole into which a threaded end of the column is screwed so that the separation is achieved by unscrewing the column relative to one of the flanges.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components.

DETAILED DESCRIPTION OF THE INVENTION

Embodiments of the invention provide a tool and methods for opening a cable having a length of filament disposed within a sheath. These embodiments provide a mechanism that allows the assistance of a powered mechanical rotation device, such as a hand-held drill, to be used in opening the cable. With such powered assistance, the risk of injury to the technician is substantially reduced. In some such embodiments, the tool uses the powered mechanical rotation device to rotate a column that grips an end of the filament with a cavity, thereby spooling the filament about the column. The filament is confined to a longitudinal region along the length of the column with a mechanism that may be removed to release the filament from the longitudinal region after it has been spooled.

Figure 1:
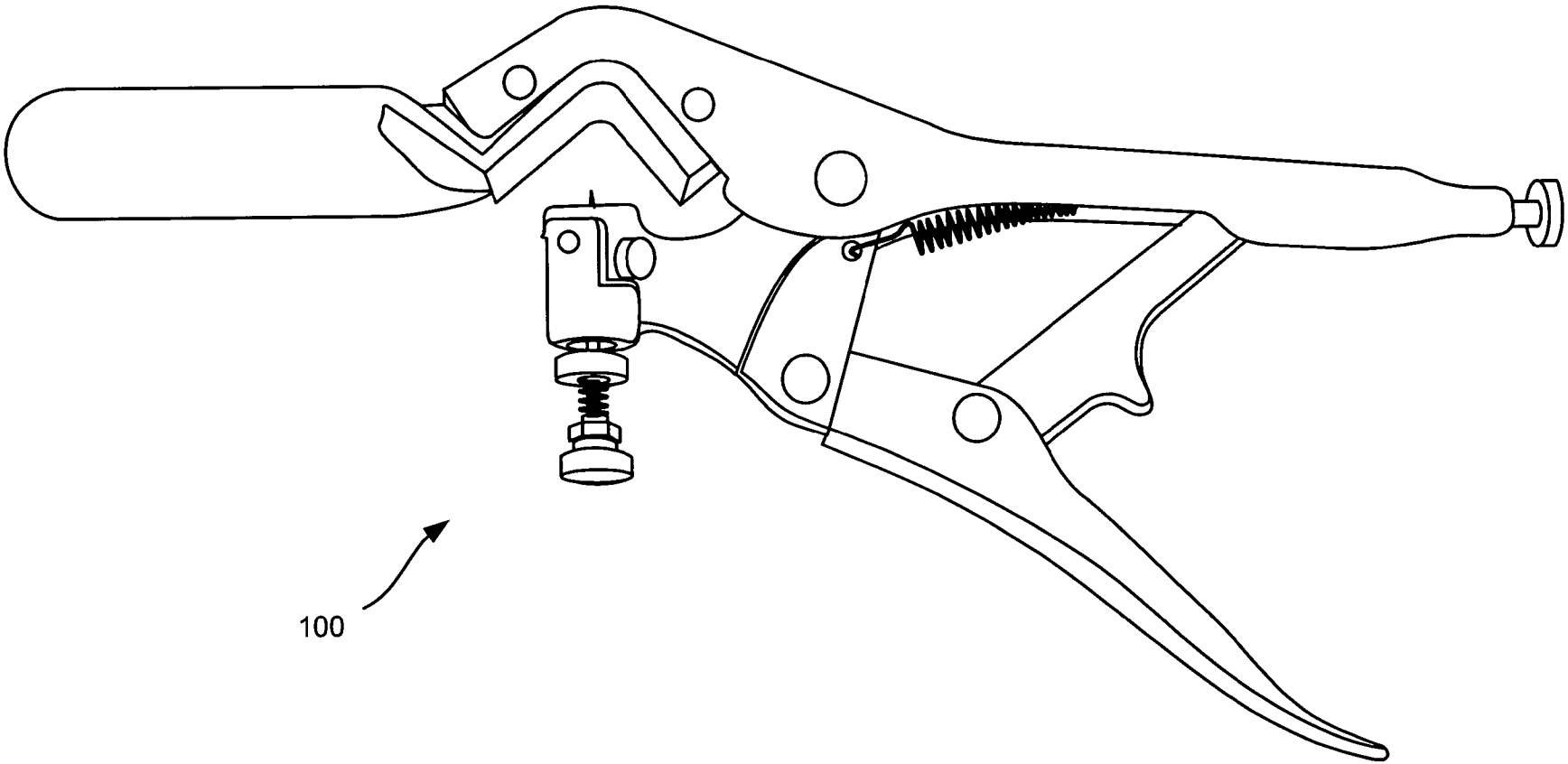
FIG. 1 (Prior Art)
FIG. 1 provides a drawing of a prior-art tool used for opening a cable having a length of filament disposed within a sheath.
Figure 2:
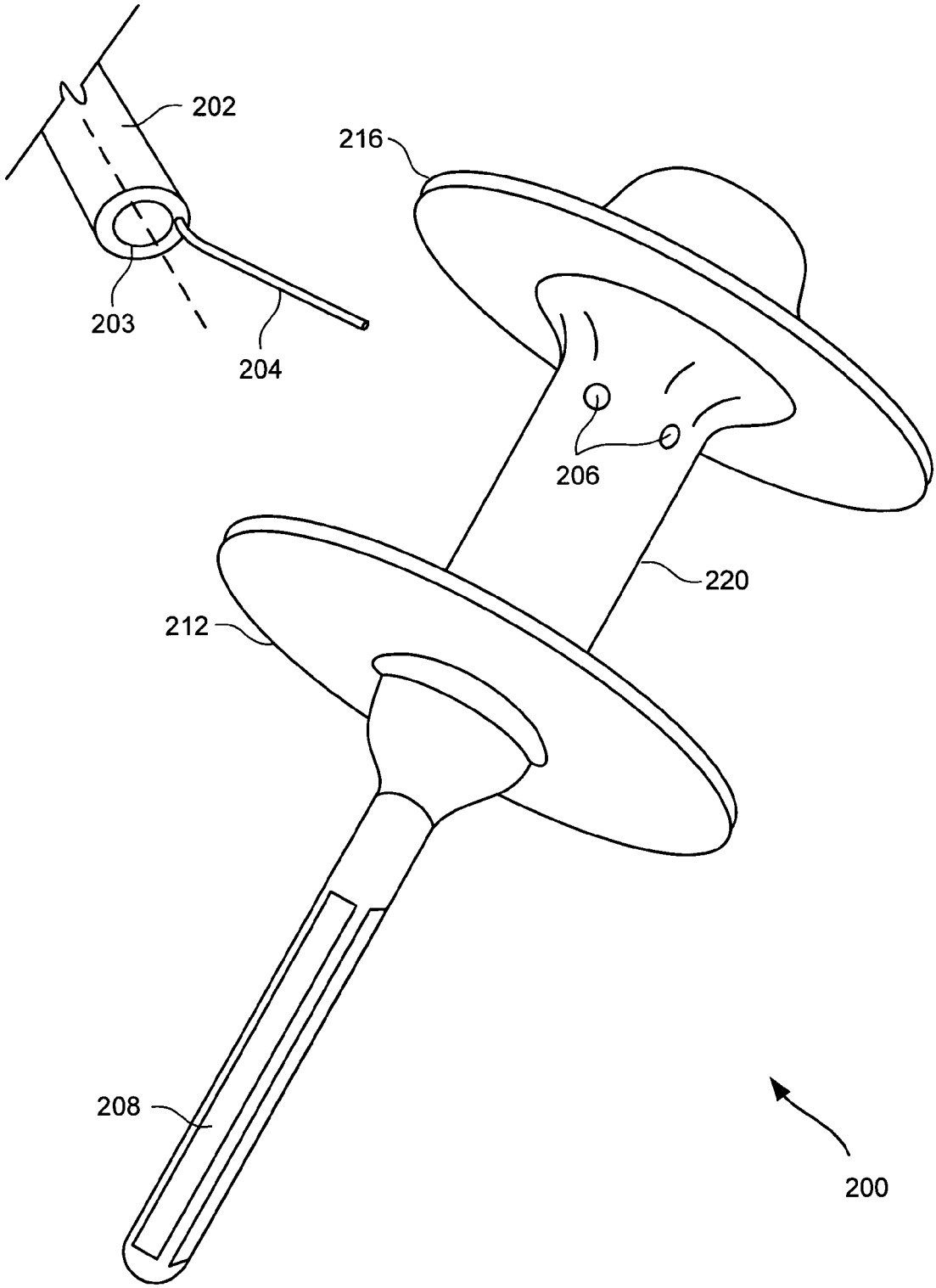
FIG. 2 provides a perspective drawing of a tool for opening a cable having a length of filament disposed within a sheath in one embodiment of the invention.

A perspective view of the tool in one embodiment of the invention is provided in FIG. 2. This view shows the tool 200 in an assembled configuration, although it will generally be possible to disassemble the tool as described further below to remove the spooled filament. In the drawing, the cable 202 with the internal filament 204 is shown schematically. In certain specific embodiments, the cable comprises a fiber optic cable having an optical component 203, which may itself comprise a metallic shield surrounding a buffer tube containing several groups of fibers. In such an embodiment, the filament may correspond to an internal strength member or piano wire. When assembled, the tool 200 includes a shaft 208 that is adapted for engagement with the powered mechanical rotation device. For example, in one embodiment the shaft 208 has a length and shape that makes it suitable for insertion and securing in the chuck of a hand-held drill. A pair of flanges 212 and 216 define the longitudinal region over the length of the column 220 where the filament 204 is spooled as the tool is rotated about its longitudinal axis by the drill. Both of the flanges 212 and 216 are connected with the column 220 and a proximal one of the flanges 212 is connected with the shaft 208.

One or more cavities 206 are provided on the column to grip the filament 204 and thereby act as an anchor for the filament 204 on the tool 200 as the tool 200 is rotated to spool the filament 204. In one embodiment where the column 220 comprises a hollow interior, the cavities 206 may comprise holes that extend through a surface of the column 220 to the hollow interior. This allows an end of the filament to be inserted through the holes for securing the end of the filament to the column 220 as the tool 200 is rotated. The position of the cavities 206 at a distal end of the column 220 is shown in FIG. 2 merely for illustrative purposes. In other embodiments, the cavities 206 could alternatively be positioned at a proximal end of the column 220 or at an interior position.

Figure 3A:
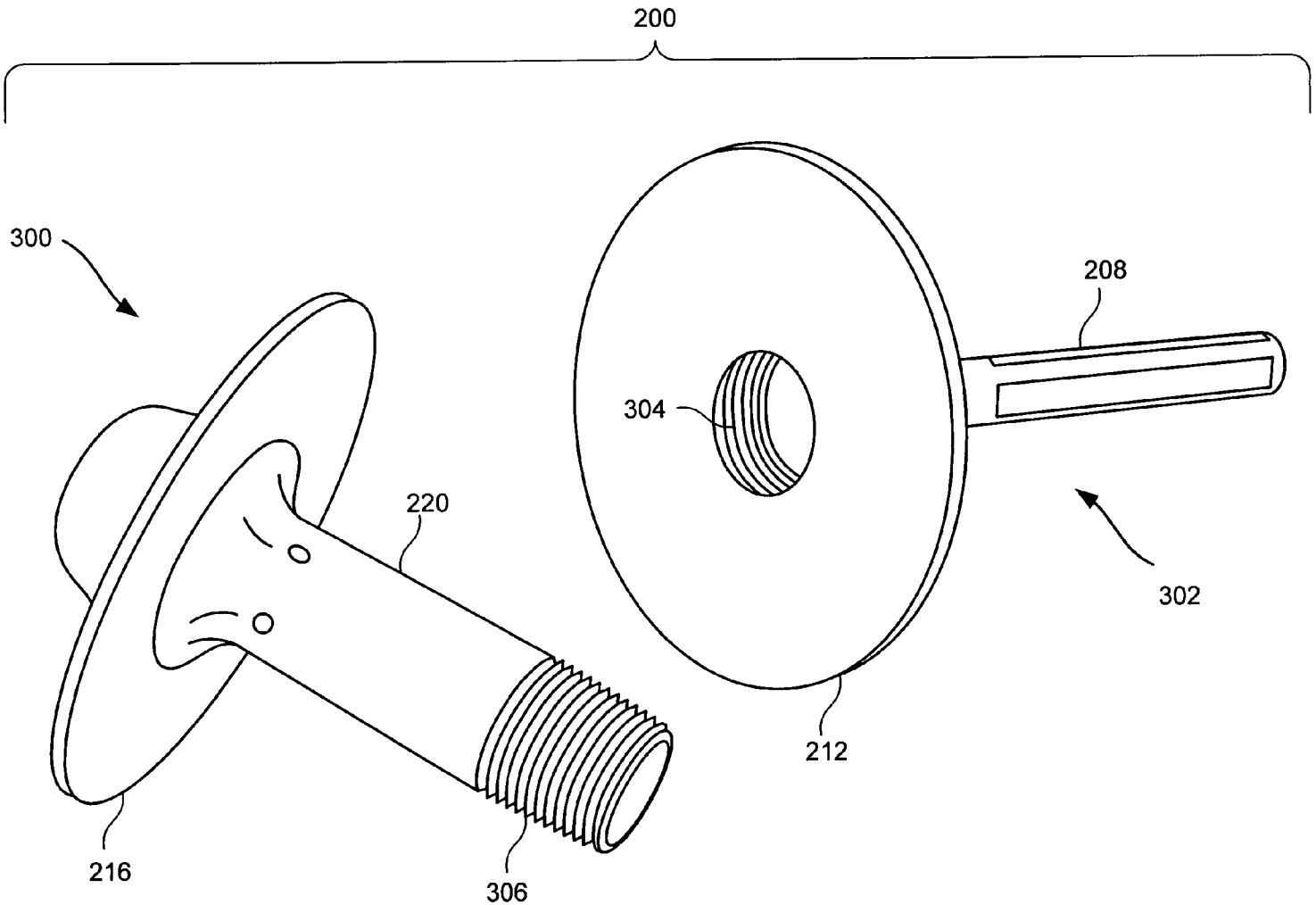
FIG. 3A provides a perspective drawing of the tool shown in FIG. 2 when disassembled according to one embodiment.

In some embodiments, the tool 200 is structured for easy disassembly into proximal and distal portions. Usually, each of the proximal and distal portions comprises one of the flanges 212 and 216 so that the spooled filament 204 may be readily removed from the confining longitudinal region along the column 220 when the tool 200 is disassembled. FIG. 3A provides an illustration of one embodiment in which the tool 200 is structured for disassembly between the proximal flange 212 and the column 220. In this embodiment, the column 220 is conveniently threaded at its proximal end 306 and the proximal flange 212 comprises a threaded hole 304 so that the distal portion 300 of the tool 200 may easily be screwed from the proximal portion 302. Thus, in this embodiment, the proximal portion 302 of the tool 200 comprises the proximal flange 212 and the shaft 208 while the distal portion 300 comprises the distal flange 216 and the column 220. A variety of alternative mechanisms for detachably engaging the proximal and distal portions 300 and 302 may be provided in alternative embodiments instead of the threaded screwing mechanism illustrated. Examples include pin or clamping mechanisms to hold the portions together while the tool 200 is used to spool the filament 204, among other detachable engagement mechanisms that will be known to those of skill in the art.

In another embodiment, the tool 200 could be structured for disassembly between the column 220 and the distal flange 216, such as by having the distal flange 216 include a threaded hole into which a threaded distal end of the column 220 may be screwed. In such an embodiment, the proximal portion 302 would comprise the shaft 208, the proximal flange 212, and the column 220 while the distal portion 300 would comprise the distal flange 216. In both this embodiment and the embodiment shown explicitly in FIG. 3A, the flange that is not detachably engaged with the column 220 may be fixedly coupled with the column 220, although this is not a requirement. For example, in the embodiment shown in FIG. 3A, the distal flange 216 might be welded to or formed continuously with the column 220; similarly, in the embodiment where the distal flange 216 is configured for detachable engagement with the column 220, the proximal flange 212 might be welded to or formed continuously with the column 220.

In still other embodiments, the tool may be configured so the column 220 is detachably engaged at both ends. For instance, in one such embodiment both the distal flange 216 and the proximal flange 212 may comprise threaded holes into which threaded distal and proximal ends of the column 220 are screwed. In that embodiment, the proximal portion 302 comprises the proximal flange 212 and the shaft 208, the distal portion 300 comprises the distal flange 216, and the column 220 is comprised by an intermediate portion of the tool 200.

Figure 3B:
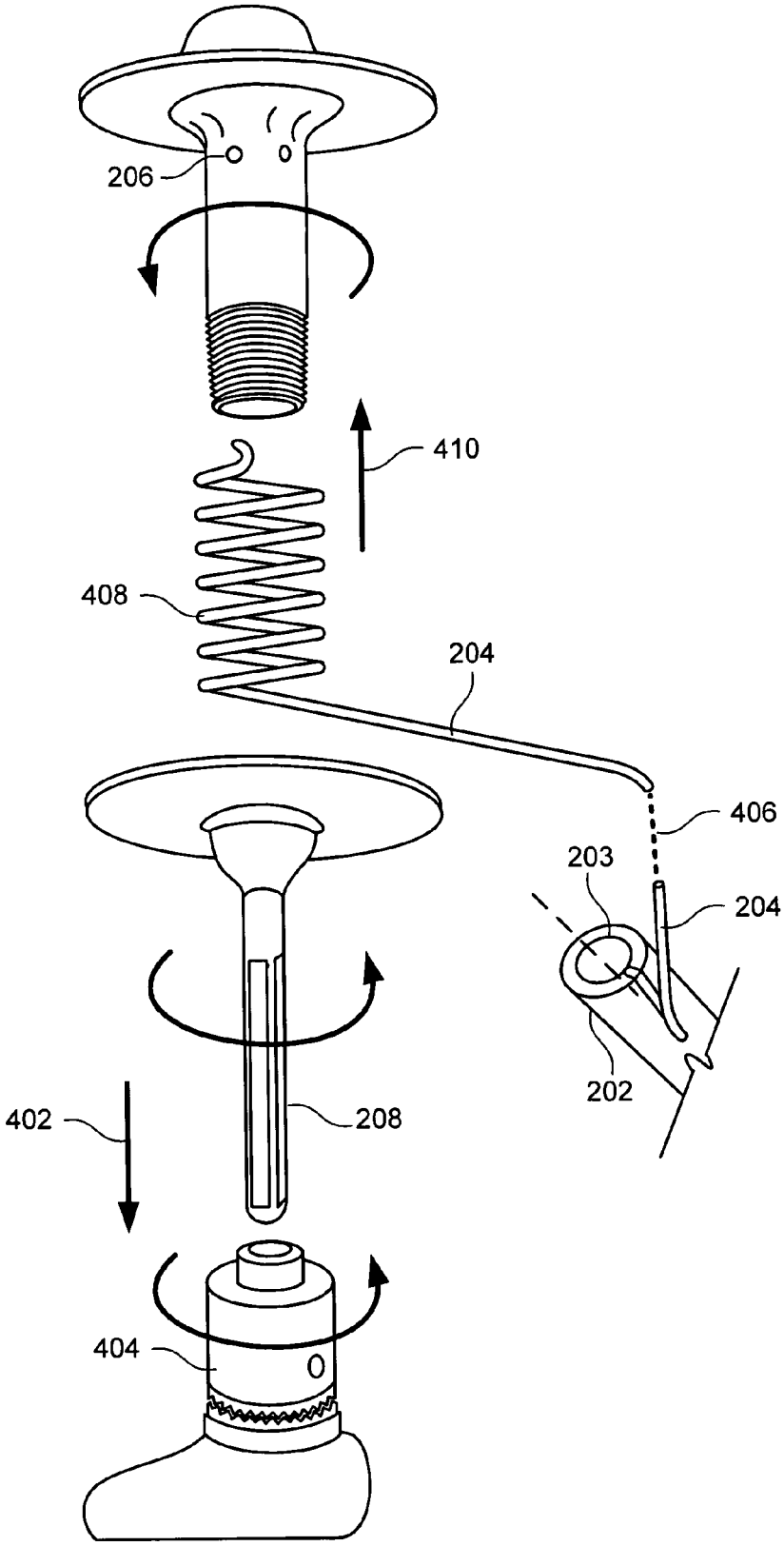
FIG. 3B provides an exploded view of the embodiment of the tool shown in FIGS. 2 and 3A when used to open a cable having a length of filament disposed within a sheath.

The operation of the tool 200 is illustrated with the exploded view shown in FIG. 3B. This view shows a spooled coil 408 of filament 204 that results from operation of the tool 200 to open the cable 202. The filament 204 was spooled by initially attaching an end of the filament 204 to the cavity 206 adapted to grip the filament. As indicated by arrow 402, the shaft 208 of the tool 200 is then inserted and secured in the chuck 404 of a handheld drill. Operation of the drill causes rotation of the column to pull the filament 204 from the sheath of the cable 202, thereby spooling the filament 204 about the column 220. Thereafter, as indicated by arrow 410, one of the flanges, in this instance the proximal flange 212, is separated from the column to release the coil 408 of spooled filament.

Figure 4B:
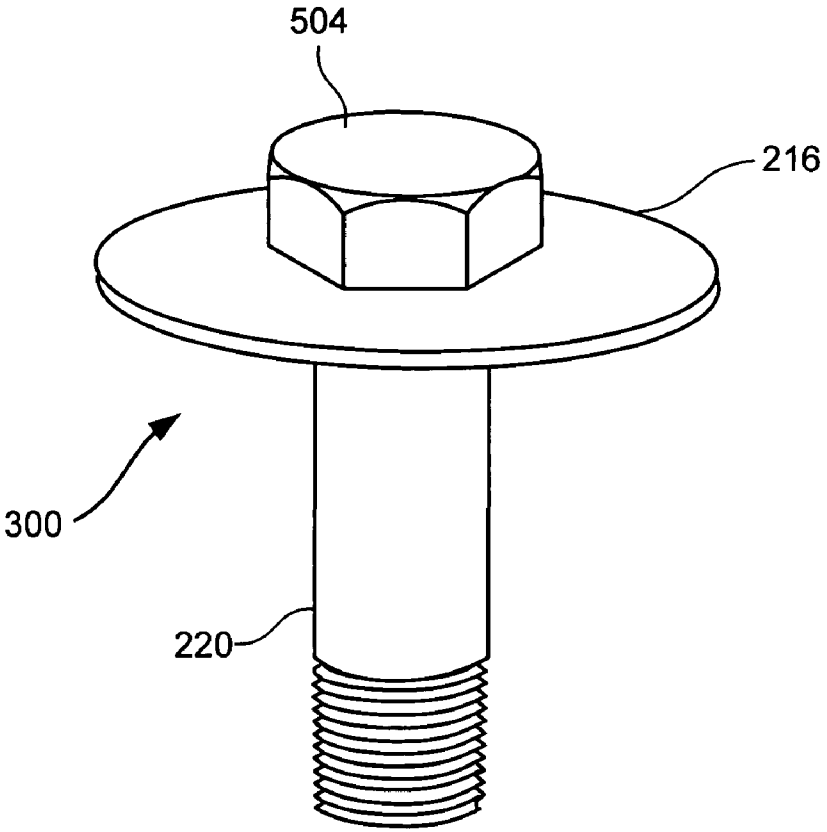
FIGS. 4A and 4B provide exemplary alternative embodiments for a distal portion of the tool for opening a cable.
Figure 4A:
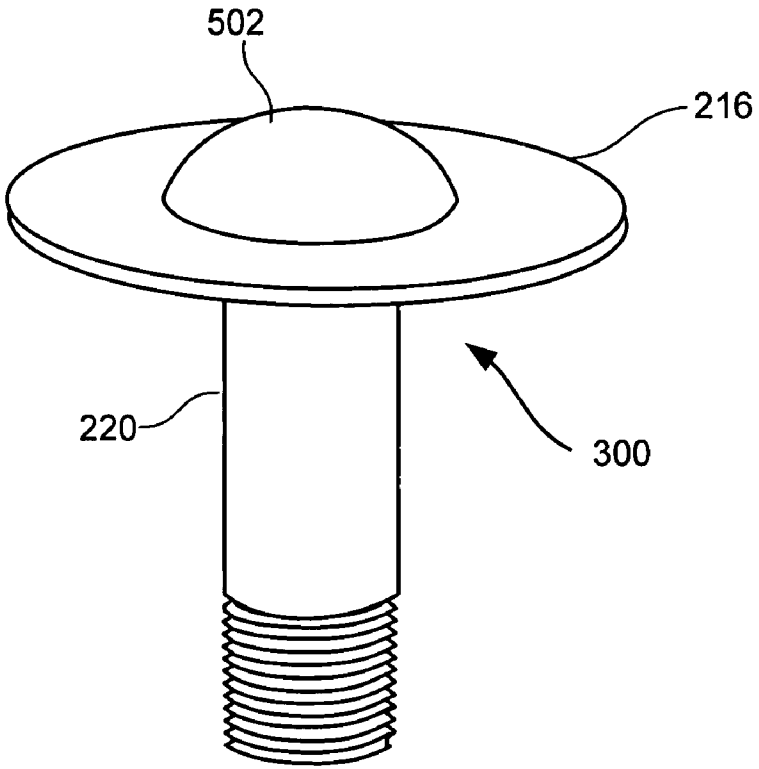

FIGS. 4A and 4B provide illustrations of alternative configurations that may be used for the distal portion 300 of the tool 200. For example, as shown in FIG. 4A, in some embodiments the distal portion 300 may comprise a cap 502 used in securing the distal flange 216 to the column 220. In other embodiments, like the one illustrated in FIG. 4B, a hex cap 504 may be provided in securing the distal flange 216 to the column 220. The use of such a hex cap advantageously permits the use of a wrench or similar tool to disengage the distal portion from the proximal portion. This feature may be especially useful in case the operation of the powered mechanical rotation device causes tightening of threaded connections.

The tool 200 may be fabricated using a variety of different techniques. For instance, in some embodiments, the portions of the tool 200 are fabricated from metal, but in other embodiments they may be fabricated from any material with sufficient strength to permit use in the manner described above. In one embodiment, portions of the tool 200 are fabricated from a heavy-duty plastic material. In such an embodiment, injection-molding techniques may advantageously be used as part of the fabrication process. For example, the proximal and distal portions 300 and 302 could be poured using injection molding with a metal shaft 208 integrated into the proximal portion 302.

Having described several embodiments, the above description should not be taken as limiting the scope of the invention, which is defined in the following claims.

What is claimed is:

1. A tool for opening a cable having a length of filament disposed within a sheath, the tool comprising:

a proximal portion having a shaft and a first flange, wherein the shaft is fixedly coupled with the first flange and is configured to be engaged with a powered mechanical rotation device comprising a chuck, wherein the shaft comprises a flat surface configured to be inserted and secured into the chuck; and a distal portion having a second flange comprising a cap configured to be turned with another tool; and a column coupled with the distal portion and fixedly coupled with the cap, the column mechanically and detachably engaged with the proximal portion and including a cavity adapted to grip the filament and disposed such that the cavity is between the first and second flanges when the column is engaged with the proximal portion.

2. The tool recited in claim 1 wherein:

the column comprises a hollow interior; and the cavity comprises a hole extending through a surface of the column to the hollow interior.

3. The tool recited in claim 1 wherein cavity comprises a plurality of cavities, each such cavity being adapted to grip the filament.

4. The tool recited in claim 1 wherein the powered mechanical rotation device is a hand-held drill.

5. The tool recited in claim 1 wherein:

the first flange comprises a threaded hole; and the column is threaded at a proximal end for threading into the threaded hole, whereby the column is detachably engaged with the proximal portion and coupled with the distal portion.

6. A method for opening a cable having a length of filament disposed within a sheath, the method comprising:

attaching an end of the filament to a tool having a column fixedly coupled with a distal flange, wherein the distal flange is fixedly coupled with a cap configured to be turned with another tool, and wherein the column is mechanically and detachably engaged with a proximal flange having a shaft comprising a flat surface configured to be inserted and secured into a chuck of a powered mechanical rotation device, and the column includes a cavity adapted to grip the filament;

inserting and securing the shaft into the chuck of the powered mechanical rotation device;

thereafter, rotating the shaft with the powered mechanical rotation device to pull the filament from the sheath and to spool the filament about the column; and thereafter, separating the proximal flange from the column to release the spooled filament.

7. The method recited in claim 6 wherein the powered mechanical rotation device is a hand-held drill.

8. The method recited in claim 6 wherein:

the proximal flange comprises a threaded hole into which a threaded end of the column is screwed; and separating the one of the flanges from the column comprises unscrewing the colunm relative to the proximal flange.

9. The method recited in claim 6 wherein the filament comprises a strength member of an optical-fiber cable.

10. A tool for opening a cable having a length of filament disposed within a sheath, the tool comprising:

a powered mechanical rotation device comprising a chuck;

a proximal portion having a shaft and a first flange, wherein the shaft is fixedly coupled with the first flange and is engaged with the powered mechanical rotation device, wherein the first flange comprises a threaded hole and the shaft comprises a flat surface configured to be inserted and secured into the chuck;

a distal portion having a second flange comprising a hex cap configured to be turned with a wrench; and a column coupled with the distal portion and fixedly coupled with the hex cap, wherein the column is threaded at a proximal end for threading into the threaded hole, the column mechanically and detachably engaged with the proximal portion and including a cavity adapted to grip the filament and disposed such that the cavity is between the first and second flanges when the colunm is engaged with the proximal portion.

* * * * *